US009166352B2

(12) United States Patent
Hansen

(10) Patent No.: US 9,166,352 B2
(45) Date of Patent: Oct. 20, 2015

(54) DOWNHOLE ELECTRICAL COUPLER FOR ELECTRICALLY OPERATED WELLBORE PUMPS AND THE LIKE

(75) Inventor: Henning Hansen, Alicante (ES)

(73) Assignee: HANSEN ENERGY SOLUTIONS LLC, The Woodlands, TX (US)

( * ) Notice: Subject to any disclaimer, the term of this patent is extended or adjusted under 35 U.S.C. 154(b) by 427 days.

(21) Appl. No.: 13/695,632

(22) PCT Filed: May 5, 2011

(86) PCT No.: PCT/US2011/035337

§ 371 (c)(1),
(2), (4) Date: Nov. 1, 2012

(87) PCT Pub. No.: WO2011/143043

PCT Pub. Date: Nov. 17, 2011

(65) Prior Publication Data

US 2013/0043019 A1 Feb. 21, 2013

Related U.S. Application Data

(60) Provisional application No. 61/332,829, filed on May 10, 2010.

(51) Int. Cl.

| | |
|---|---|
| ***E21B 43/00*** | (2006.01) |
| ***E21B 17/02*** | (2006.01) |
| ***H01R 39/08*** | (2006.01) |
| ***E21B 43/12*** | (2006.01) |
| ***H01R 13/523*** | (2006.01) |

(52) U.S. Cl.

CPC ..... *H01R 39/08* (2013.01); *E21B 17/028* (2013.01); *E21B 43/128* (2013.01); *H01R 13/523* (2013.01)

(58) Field of Classification Search

None

See application file for complete search history.

(56) References Cited

U.S. PATENT DOCUMENTS

| | | | | |
|---|---|---|---|---|
| 6,415,869 | B1 | 7/2002 | Smith | |
| 8,286,712 | B2 * | 10/2012 | Wilson | 166/338 |
| 2002/0050361 | A1 | 5/2002 | Shaw | |
| 2006/0243450 | A1 | 11/2006 | Head | |
| 2010/0025045 | A1 * | 2/2010 | Lake et al. | 166/373 |
| 2010/0206577 | A1 * | 8/2010 | Martinez | 166/369 |
| 2011/0011596 | A1 * | 1/2011 | Martinez et al. | 166/372 |

OTHER PUBLICATIONS

Communication relating to the results of the partial international search in PCT/US2011/035337, dated Oct. 22, 2012.

International Preliminary Report on Patentability, from PCT/US2011/035337, Jan. 29, 2013.

International Search Report, from PCT/US2011/035337, Jan. 16, 2013.

* cited by examiner

*Primary Examiner* — Giovanna C Wright

(74) *Attorney, Agent, or Firm* — Richard A. Fagin; Adenike Adebiyi

(57) ABSTRACT

An electrical coupling system for use in a wellbore that enables insertion and removal of an electrically operated device in a wellbore includes an electrical receptacle mounted at a selected axial position along a tubing disposed in the wellbore. The receptacle includes at least one insulated electrical conductor coupled to an electrical contact inside the receptacle and extending to the well surface. An electrical coupler is disposed on an exterior of the electrically operated device. The coupler includes at least one electrical contact disposed proximate the receptacle contact when the coupler is mated to the receptacle. The coupler including at least one flow passage enabling wellbore fluid flow from below the coupler to an annular space between the electrically operated device and an interior of the tubing.

21 Claims, 12 Drawing Sheets

DOWNHOLE ELECTRICAL COUPLER FOR ELECTRICALLY OPERATED WELLBORE PUMPS AND THE LIKE

BACKGROUND OF THE INVENTION

1. Field of the Invention

The invention relates generally to the field of downhole electrical coupling in hydrocarbon producing wells. More specifically, the invention relates to an electrical connector mechanism that can be connected within a fluid environment, where the connector provides electrical contact for electrically operated devices such as submersible pump systems, "intelligent" completion systems, wellbore sensing systems and the like.

2. Background Art

Downhole electrical pumps used in wells to lift formation fluids to the surface are typically installed as an integrated and permanent part of the production tubing. In such systems, the wellbore tubing needs to be pulled out of the wellbore if the pump or any of its associated components needs to be repaired or maintained. FIG. 1 illustrates an industry standard method and device known in the art for a wellbore where a tubing deployed, electrically operated submersible pump system is installed therein for lifting well fluids to the surface (i.e., to the wellhead). Production of fluids to surface moves through a production tubing (2P) mounted above the outlet of the pump system. The pump system typically comprises an electrically operated centrifugal type pump (3), a pump intake (4) for entry of wellbore fluids into the pump (3), a motor protector/seal system (5) and a electric motor system (6). The pump system provided electrical power through an electrical cable (7) extended from the surface and coupled to the motor (6), wherein the electrical cable (7) is typically mounted on the exterior of the production tubing (2P) and extends to the well surface.

If the pump system shown in FIG. 1 fails or needs repair, the entire system including the production tubing (2P) needs to be retrieved to the surface. This can be difficult and expensive, as it will typically require a workover rig or similar lifting unit to retrieve the tubing (2P) from within the casing (1).

Thus, a need exists for a wellbore pump system and other electrically operated devices that can be retrieved and reinstalled without pulling the tubing and attached electrical device and which includes only minimum changes to existing electrically powered devices such as electrically powered wellbore pumps.

SUMMARY OF THE INVENTION

An electrical coupling system for use in a wellbore that enables insertion and removal of an electrically operated device in a wellbore includes an electrical receptacle mounted at a selected axial position along a tubing disposed in the wellbore. The receptacle includes at least one insulated electrical conductor coupled to an electrical contact inside the receptacle and extending to the well surface. An electrical coupler is disposed on an exterior of the electrically operated device. The coupler includes at least one electrical contact disposed proximate the receptacle contact when the coupler is mated to the receptacle. The coupler including at least one flow passage enabling wellbore fluid flow from below the coupler to an annular space between the electrically operated device and an interior of the tubing.

Other aspects and advantages of the invention will be apparent from the description and claims which follow.

BRIEF DESCRIPTION OF THE DRAWINGS

In FIG. 4, no seal is needed between the pump system and the wellbore tubular.

DETAILED DESCRIPTION

Figure 1:
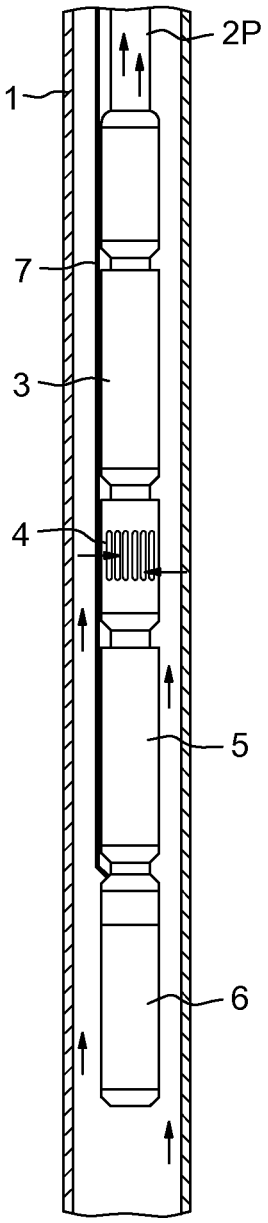
FIG. 1 (PRIOR ART)
FIG. 1 illustrates a typical electrical pump system known in the art disposed in a wellbore below the surface or water bottom, where it can be observed that the production tubing needs to be pulled to repair or change out the pump system.
Figure 2:
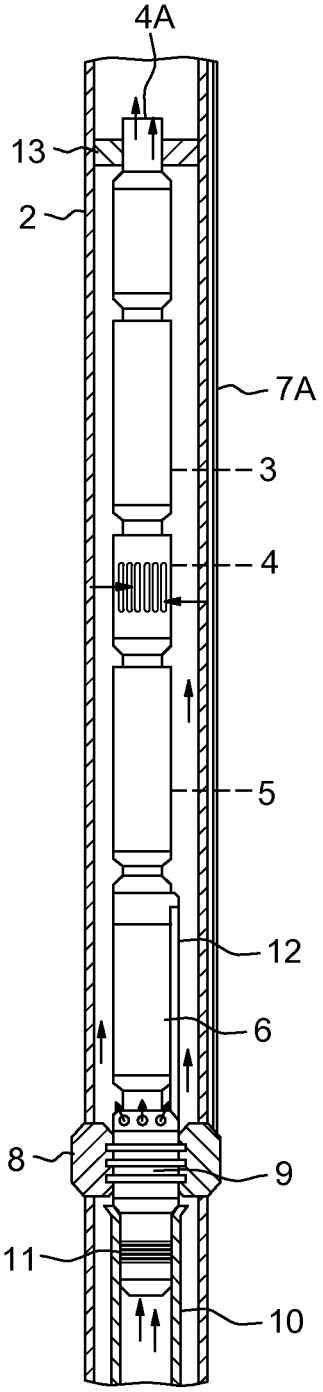
FIG. 2 illustrates an example device and method according to the invention for installing a downhole electrical pump system based on a downhole electrical coupler system, where the production tubing does not need to be pulled to repair or replace the pump system. A conduit for electrical cables requires that the pump is mounted from the coupler to the motor. The pump system can be retrieved and installed by wireline, coiled tubing, spoolable fiber rod, or similar device. A packer arrangement above the pump prevents circulation of wellbore fluids, and ensures transport of such fluids to the surface.

FIG. 2 illustrates an example pump and electrical connector system according to the invention wherein the pump system (3, 4, 5, 6) is retrievable without having to pull the wellbore tubing (2 in FIG. 1) from out of the wellbore. The present example includes such capability by introducing a "wet" matable electrical coupler (9) (meaning that electrical connection may be made while submerged in wellbore fluid) disposed in the lower end of the pump system (3, 4, 5, 6). The electrical coupler (9) is landed into an electrical coupler receptacle (8) mounted onto the production tubing (2). Electrical cables from the electrical coupler (9) to an electric motor (6) may be incorporated in a bypass conduit (12) coupled between the electrical coupler (9) and the electric motor (6). The foregoing components allow the pump system to be installed within the production tubing (2) as well as retrieved from the production tubing (2) in a cost efficient way by using winch supported well intervention methods such as coiled tubing, wireline, spoolable fiber rod or similar method. As a result, it is not necessary to remove the production tubing (2) in order to remove the pump system for service or replacement.

With certain exceptions, such as the bypass conduit (12) noted above, and a seal system explained below, the pump system may be a conventional electrical submersible pump (ESP) known in the art, having external diameter thereof selected to enable passage through the interior of the production tubing (2) as shown in FIG. 2.

A pack-off or similar annular sealing system (13) may be disposed in the annular space between the pump system and the production tubing (2). The pack-off system (13) can be mounted longitudinally anywhere along the pump system above the pump intake (4). The pack-off system (13) ensures that all discharge from the pump is forced to travel upward in the production tubing (2) and thereby prevents wellbore fluids from being circulated locally downhole from discharge to intake (4 in FIG. 1) of the pump system.

FIG. 2 also shows a seal system (11) that can be mounted below the lower section of the electrical coupler (9), where this seal system (11) provides a fluid barrier with respect to a seal receptacle (10). Wellbore fluids will thus be caused move through the center of the seal system (11), through the center of the electrical coupler (9) whereupon the fluid exits the top of the electrical coupler (9). Thereafter, the wellbore fluids are transported in the annular space outside the motor system (6). The fluid enters the pump intake (4). Then the fluids are transported through the pump (3) whereafter the fluid exits via the pump discharge (4A) (disposed on top of the pump system in the present example), followed by transport to the surface within the production tubing (2).

The electrical coupler system (receptacle 8 and coupler 9) can be a conductive contact ring coupler wherein corresponding rings in the receptacle 8 and coupler 9 make galvanic contact, or the system can be a wireless or inductive type electrical connector. The wireless electrical connector can for example be of the type that is offered by the company Wireless Power & Communication AS in Horten, Norway (www.wpc.no) and described in Norwegian Patent No. 320439 "Anordning og fremgangsmåte for kontaktløs energioverføring" ("A device and method of non-contact energy transmission"), issued to Geir Olav Gyland. Electrical power may be provided from the surface by a cable (7A) extending to the receptacle (8) outside the production tubing (2).

Figure 3:
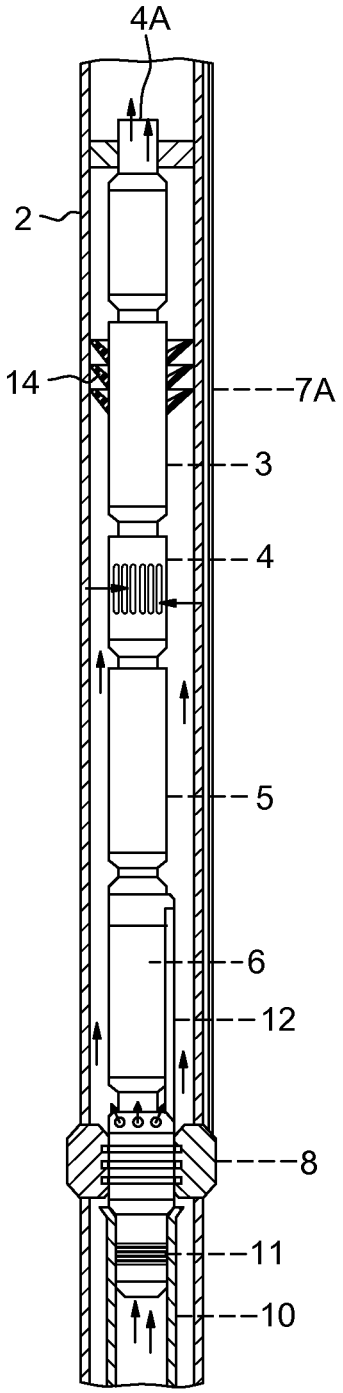
FIG. 3 illustrates the example system shown in FIG. 2, but including a swab cup arrangement instead of a packer. The swab cup prevents wellbore fluid circulation within pump system.

FIG. 3 illustrates the system as shown in FIG. 2, with the difference that the annular sealing packer system (13 in FIG. 2) between the pump system and the wellbore tubing (2) may be substituted by an elastomeric swab cup system (14) made from nitrile rubber or similar suitable elastomeric sealing material.

Figure 4:
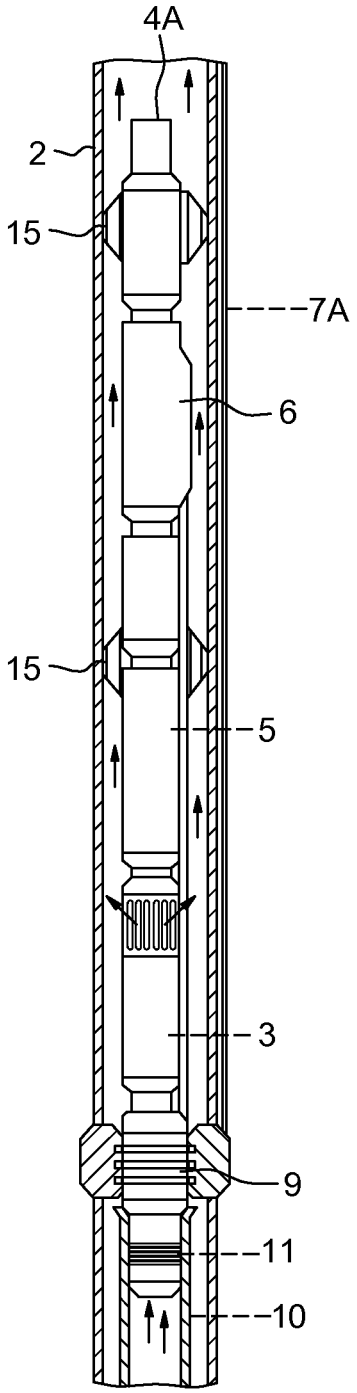
FIG. 4 also illustrates an apparatus method where a downhole electrical coupler is introduced to enable pump replacement without pulling the production tubing. In the example of FIG. 4, the pump is located below the electric motor system. Also a conduit is shown for the electrical cables required for the pump to be mounted from the coupler to the motor.

FIG. 4 illustrates another example where the pump system is configured to have the motor (6) and the protector and seal assembly (5) disposed above the pump (3). In the example of FIG. 4 no packer or other annular sealing element is required above the electrical coupler (9), because the pump intake (4) is disposed in the bottom of the system, e.g., sealed inside seal (11) and the pump discharge (4A) is disposed above the seal (11) in the production tubing (2). To centralize and stabilize the pump system within the production tubing (2), one or several centralizers (15) can be disposed between the pump system and the interior of the tubing (1).

Figure 5:
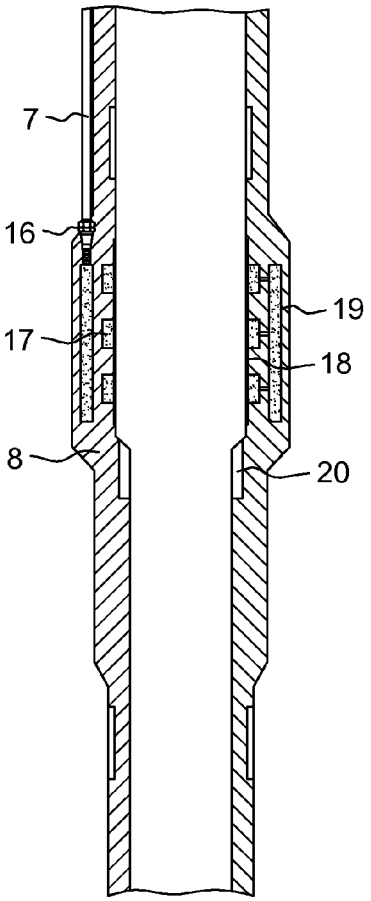
FIG. 5 illustrates a tubing mounted insert coupler receptacle for an insert coupler.

FIG. 5 illustrates the electrical coupler receptacle (8) in more detail, wherein the electrical cable (7) is coupled to the coupler receptacle (8) and is sealed against wellbore fluids by an industry standard seal system (16). Thereafter the electrical conductors in the cable (7) are connected to corresponding electrical contact rings (17). In some instances electronic controls (19) may be required to operate the pump system. Depending on the selected electrical power transmission device used, the coupler system may require a non-metallic isolation (18) between the electrical contact rings (17). In the lower section of the coupler receptacle (8), one or several recesses (20) can be machined, where the function of the recesses (20) is to enable anti rotation devices to be included in the electrical coupler to be landed into the receptacle assembly (8). The foregoing will be explained below with reference to FIG. 6.

Figure 6:
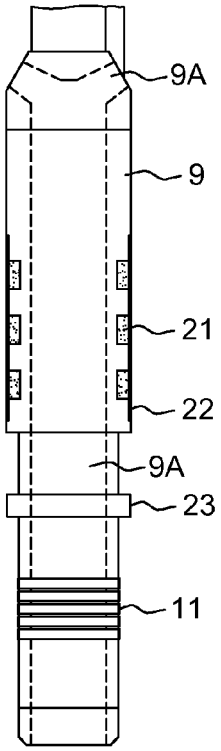
FIG. 6 illustrates an insert coupler that can be mated into a coupler receptacle as described in FIG. 5.

FIG. 6 shows the wet matable electrical coupler (9) disposed in the lower end of the pump system, where it can be observed that the coupler (9) has internal fluid flow through capabilities by internal ports (9A). Electrical contact rings (21) may be incorporated on the exterior of the coupler (9), and when the coupler (9) is fully landed in the receptacle (8) are in electrical contact with the corresponding contact rings (17 in FIG. 4) in the receptacle (8), thus transferring electrical power (and in some examples signals) to from cable (7 in FIG. 4) to the pump motor (6 in FIG. 2 and FIG. 4). Dependent on power transmission method, the coupler system may require an electrical insulation (22) externally on the electrical contact rings (21). An anti rotation lock pin system (23) may be landed into the recesses (20 in FIG. 5) machined into the electrical coupler receptacle (8 in FIG. 5). The lock pin system (23) will prevent the pump system from rotating when operated. The seal stack (11) can be mounted to the lower section of the coupler system, where the seal stack (11) will seal against external wellbore fluid passage.

Figure 7:
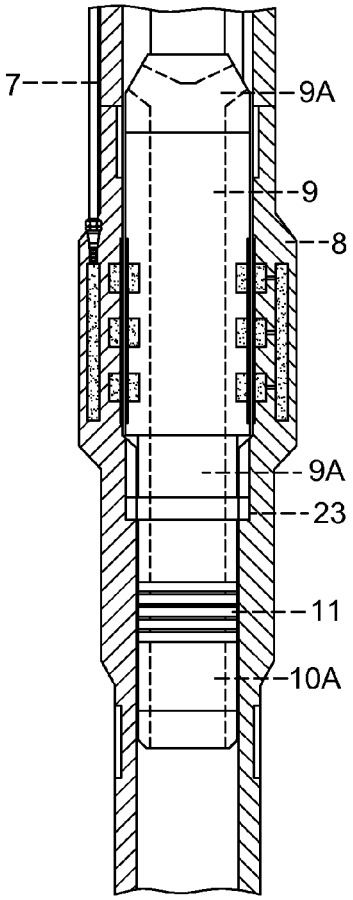
FIG. 7 illustrates the insert coupler landed into the coupler receptacle.

FIG. 7 illustrates the wet matable electrical coupler (9 in FIG. 6) fully landed into the electrical coupler receptacle (8 in FIG. 5). A system (FIGS. 10A through C explained below) for flushing the electrical contacts with, for example, dielectric fluids prior to and when mating the coupler (9) to the receptacle (8) can be incorporated into the wet mateable coupler system. Such flushing can be executed by units connecting, or by a control line from surface either coupled to the wet mateable electrical coupler (9 in FIG. 6) or the electrical coupler receptacle (8 in FIG. 5). Alternatively, the coupler system can include cup type wipers (not shown) internally to the coupler (9) to remove fluid from the contact rings (21 in FIGS. 5 and 20 in FIG. 4) when the coupler (9) is inserted into the receptacle (8).

Figure 8A:
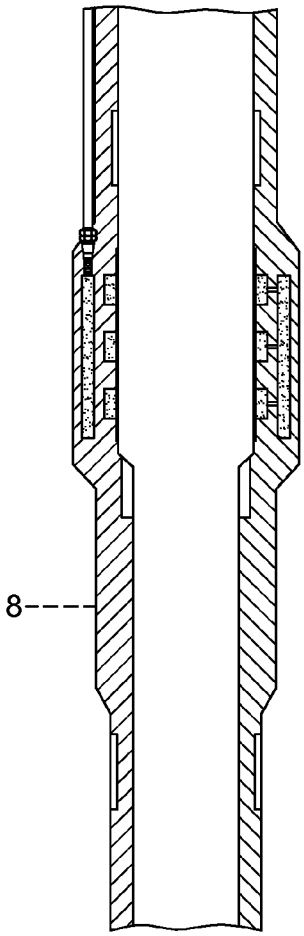
FIG. 8A illustrates a receptacle and FIG. 8B shows an insert receptacle as shown in FIG. 6, where the coupler is shown with seals between electrical coupler rings of the insert coupler.
Figure 8B:
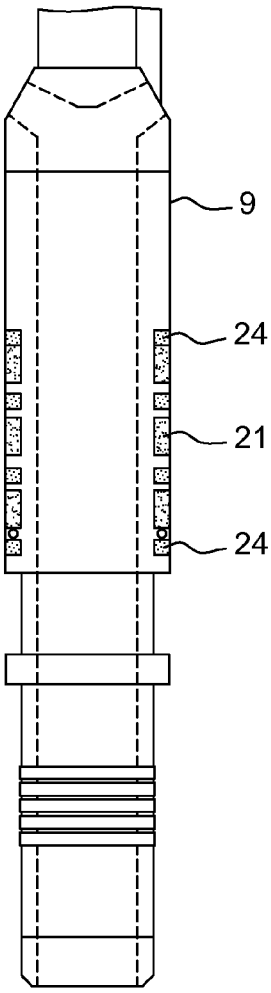

FIGS. 8A and 8B illustrate a variation of the coupler system illustrated in FIG. 6, and with particular reference to FIG. 8B wherein in seals (24) are introduced between, above and below the electrical contact rings (21) on the coupler (9). Such seals (24) will enable effective placement of dielectric fluids as well as securing isolation of fluids between the contact rings (21) when the coupler 9 is engaged to the receptacle (FIG. 8A). Hydraulic feedthrough ports (not illustrated) can also be introduced where the seals (24) will ensure pressure tight isolation between such ports. The ports can also be used for flushing the electrical coupler system with dielectric fluids prior to and when mating, and for operation of hydraulically operated tools coupled to the insert system and more.

Figure 9:
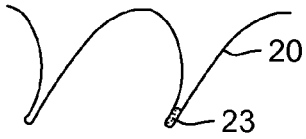
FIG. 9 illustrates in more detail an orientation recess of the insert coupler shown in FIG. 5 which includes an anti rotation lock pin as shown in FIG. 6 landed into the recess.

FIG. 9 illustrates the anti rotation lock pin (23, also in FIG. 6) landed into the lock pin recess (20, also in FIG. 5), where for example a motor housing coupled to the upper side of the pump system (see FIG. 4) is prevented from rotating during start-up and operation of the electric motor (6 in FIG. 2).

Figure 10A:
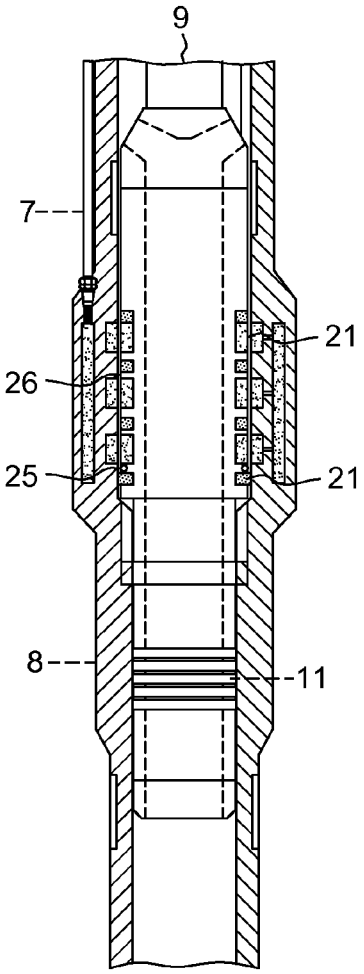
FIGS. 10A through 10C illustrates how dielectric fluid may be used to flush the electrical coupler system, and how a seal system isolates the coupler from wellbore fluids.
Figure 10B:
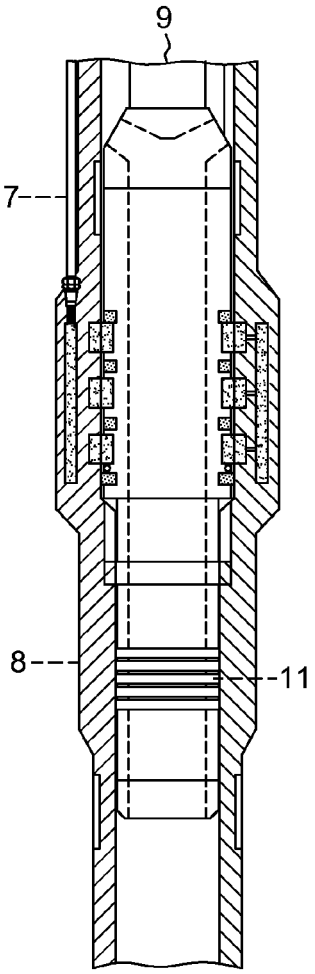
Figure 10C:
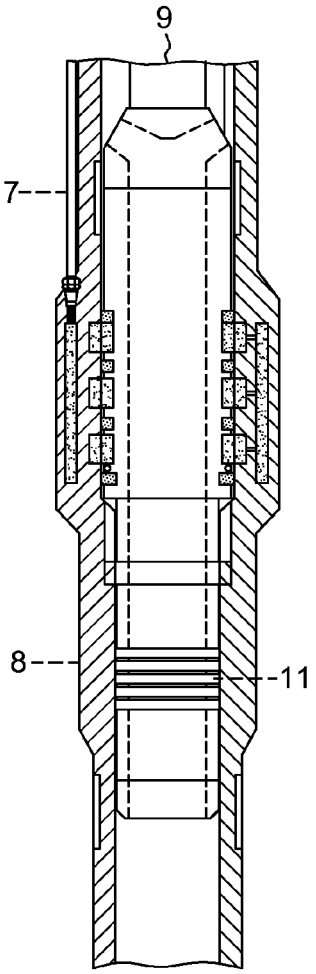

FIGS. 10A, 10B and 10C illustrate how dielectric fluid can be used to flush the electrical coupler system, and how the seal system isolates the coupler system from wellbore fluids. The foregoing is performed by engaging the lower seal (11), releasing dielectric fluid (26) via one or more exit ports (25). When all flushing fluid has been unloaded, the electrical contacts (21) are engaged followed by engaging of the remaining seals (24). This traps the dielectric fluid within the coupler contact area as well as preventing wellbore fluids from entering the coupler system during use. Also, engaging the electrical contacts (21) after sealing off the dielectric fluid around the coupler (9) will result in a increased pressure between the seals compared to the pressure of the wellbore fluids outside the coupler. This also reduces the chance of wellbore fluids entering the contact areas.

Figure 11:
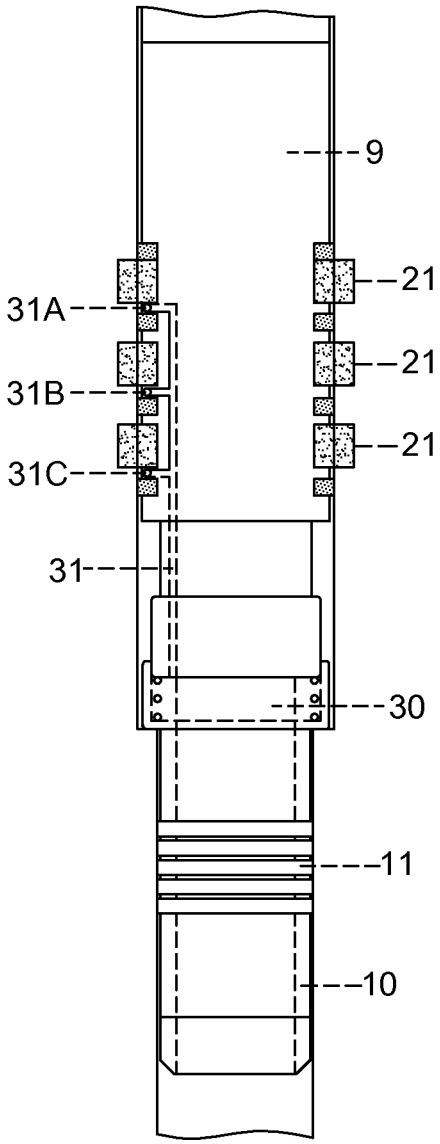
FIG. 11 shows one example of a deployment mechanism for dielectric fluid.

An example of a deployment mechanism for dielectric fluid may be better understood with reference to FIG. 11. A chamber 30 may be filled with dielectric fluid such as oil or non-conductive silicone grease. When the coupler 9 is inserted into the receptacle, the lower part of the coupler (including seal assembly 11 and port 10) may compress the chamber 30 and cause flow of the dielectric fluid through an internal line 31. The internal line 31 may have discharge ports 31A, 31B, 31C between the contacts 21, causing the fluid to displace any conductive wellbore fluid between the contacts 21.

Figure 12:
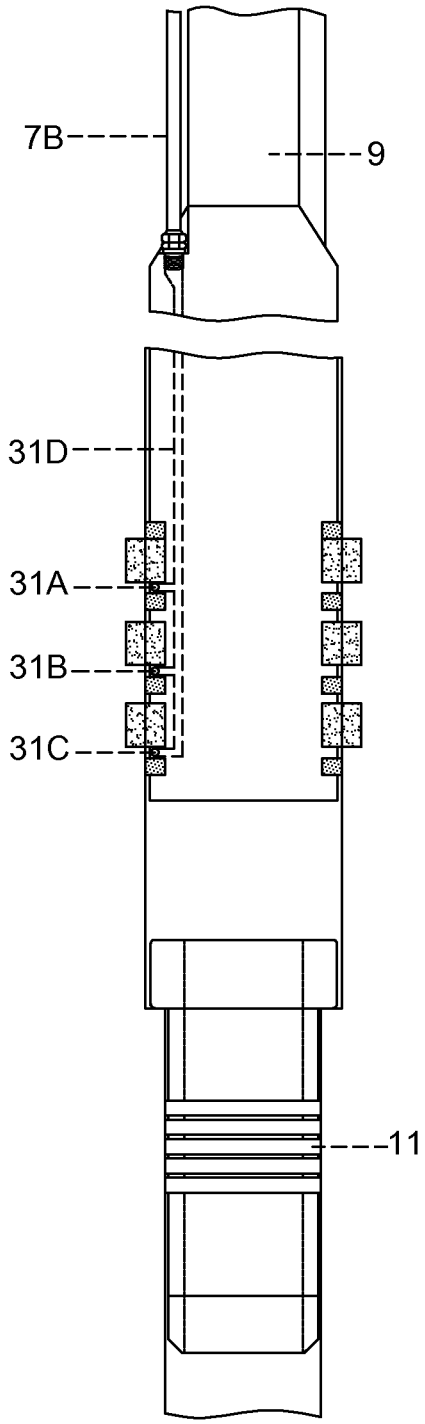
FIG. 12 shows another example of a deployment mechanism for dielectric fluid.

An alternative dielectric fluid deployment mechanism is shown in FIG. 12. A fluid line 7B may extend from the surface and be used to pump the dielectric fluid through an internal port 31D in the coupler 9. The internal port 31D may extend to discharge ports 31A, 31B, 31C similarly placed to those shown in FIG. 11.

Figure 13:
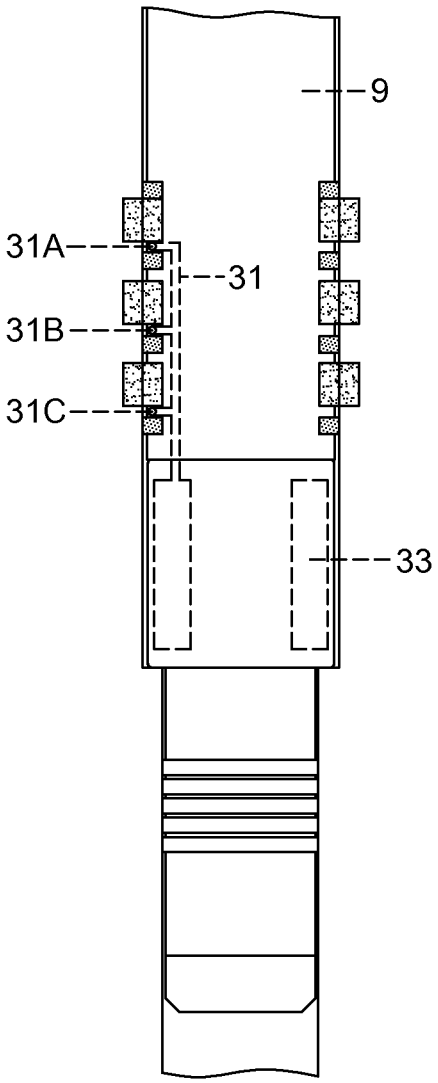
FIG. 13 shows another example of a deployment mechanism for dielectric fluid.

FIG. 13 shows a reservoir of dielectric fluid with an electronic control 33 that may be automatically operated or controlled from the surface. The electronic control may include a pump (not shown separately) to discharge dielectric fluid through an internal port 31 with discharge ports 31A, 31B, 31C similar to those shown in FIG. 11.

Figure 14:
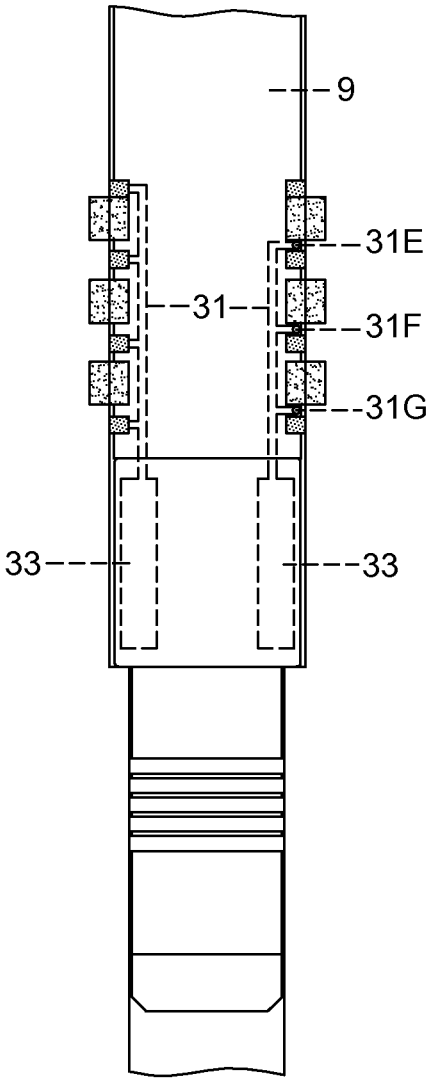
FIG. 14 shows another example of a deployment mechanism for dielectric fluid.

FIG. 14 shows an example similar to the one shown in FIG. 13, but including one or more electronic systems 33, and a second set of discharge ports 31E, 31F, 31G. The system in FIG. 14 may enable circulation of fluid through the coupler contact area.

Figure 15:
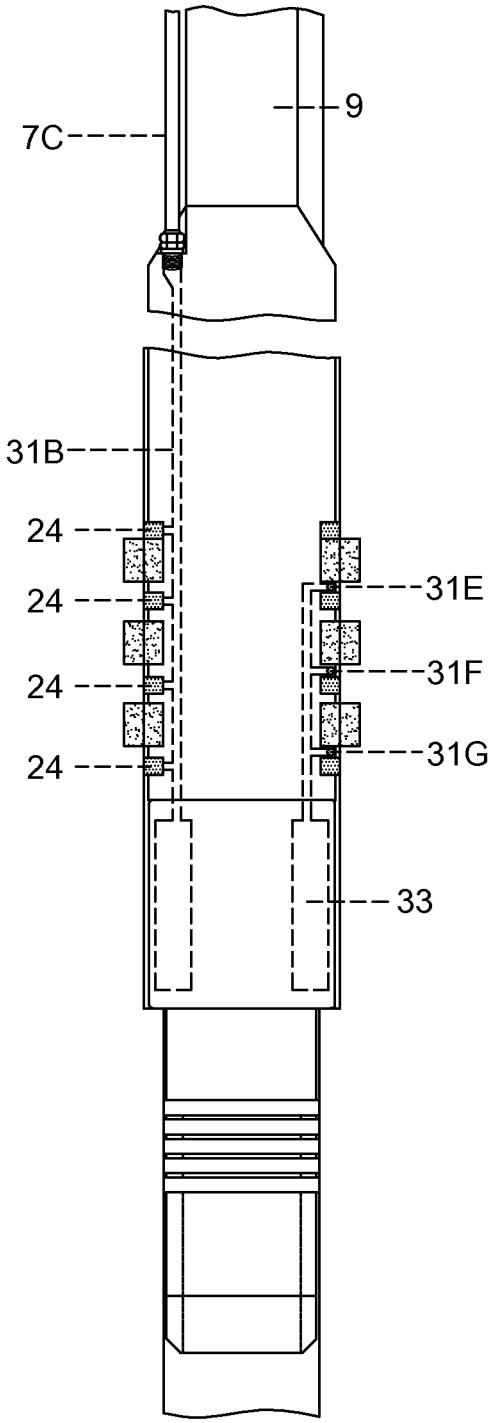
FIG. 15 shows another example of a deployment mechanism for dielectric fluid.

FIG. 15 shows a coupler 9 with a control line 7B to the surface through which fluid may be pumped through an internal port 31B in the coupler 9 to energize the seals 24. The system in FIG. 15 may also include an electronic system 33 for discharge of dielectric fluid through ports 31E, 31F, 31G as in FIG. 14.

Figure 16:
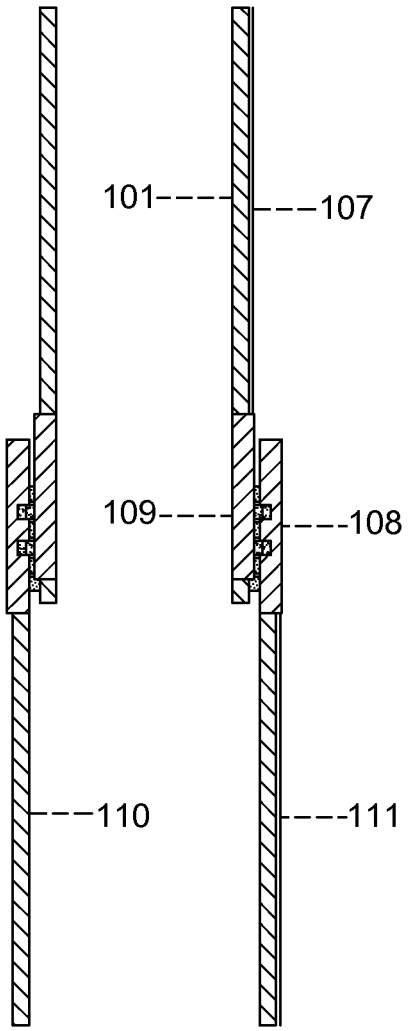
FIG. 16 shows use of the coupler where it is used for, e.g., so called "two-stage" well completions, where a lower tubular string (e.g., casing) is placed in the well first with sensors etc. along the casing. Thereafter, an upper completion string (e.g., tubing) is landed into this lower string using the coupler having cable(s) and possibly control line(s) to the wellhead.

FIG. 16 shows use of the coupler where it is used for, e.g., so called "two-stage" well completions, where a lower tubular string 110 (e.g., casing) is placed in the well first with sensors etc. along the casing. The lower tubular string 110 includes a receptacle 108 which may be made according to the various examples explained above. A control line 110 may extend to sensors and other electrically and/or hydraulically operated devices lower in the well. Thereafter, an upper completion string 101 (e.g., tubing) is landed into this lower string 110 using the coupler 109 having cable(s) 107 and possibly control line(s) to the wellhead. The coupler 109 may be made according to the various examples explained above.

Figure 17:
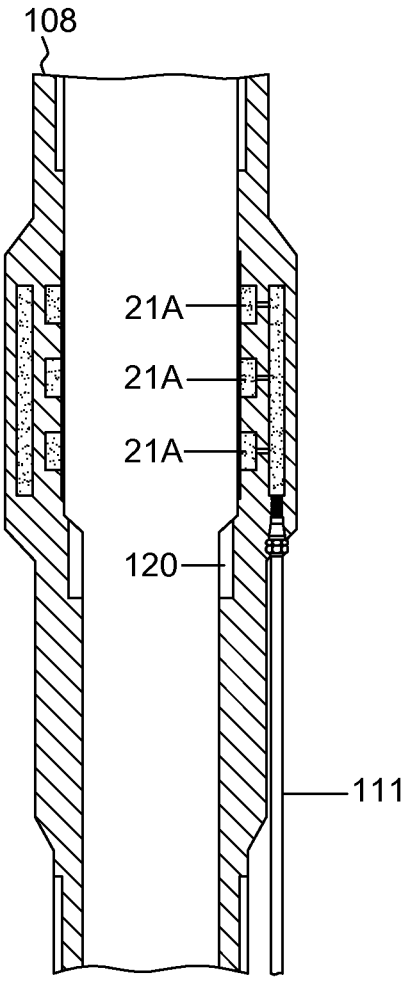
FIG. 17 shows the receptacle of FIG. 16 in more detail.
Figure 18:
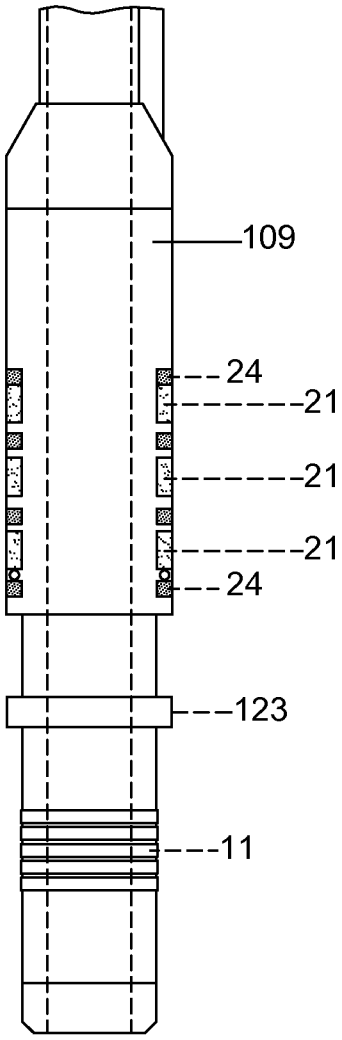
FIG. 18 shows the coupler of FIG. 16 in more detail.

FIG. 17 shows the receptacle 108 of FIG. 16 in more detail. The receptacle 108 includes an internal shoulder 120, with or without anti-rotation elements for receiving a corresponding shoulder (123 in FIG. 18). Electrical and/or hydraulic contacts 21A may be provided to make corresponding connection with electrical and/or hydraulic contacts in the coupler (FIG. 18). The contacts 21A may be connected to a control line 111 or cable that extends to devices lower in the well, e.g., sensors and/or valves.

FIG. 18 shows the coupler 109 of FIG. 16 in more detail. The coupler includes the above described components and electrical and/or hydraulic contacts 21. The contacts 21 may be isolated by seals 24. A seal extension 11 may sealingly engage the interior of the lower part of the receptacle (108 in FIG. 17) so that when the tubing is mated to the casing, a fluid tight seal is provided.

An electrical coupler system and/or ESP combination according to the foregoing examples may enable insertion and retrieval of an ESP system or other electrically operated device supported on a wellbore tubing to be installed and removed from the wellbore without the need to remove the tubing from the wellbore.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An electrical coupling system for use in a wellbore that enables insertion and removal of an electrically operated device in a wellbore, comprising:

an electrical receptacle mounted at a selected axial position along a tubing disposed in the wellbore, the receptacle including at least one insulated electrical conductor coupled to an electrical contact inside the receptacle and extending to the well surface; and an electrical coupler disposed on an exterior of the electrically operated device, the coupler including at least one electrical contact disposed proximate the receptacle contact when the coupler is mated to the receptacle, the coupler including at least one flow passage enabling wellbore fluid from below the coupler to an annular space between the electrically operated device and an interior of the tubing;

wherein the electrically operated device comprises an electrical submersible pump system having a motor disposed above the pump, and wherein the system comprises a seal assembly below the pump system such that no annular seal is required between the pump system and the wellbore tubing.

2. The coupling system of claim 1 wherein the at least one electrical contact in each of the coupler and receptacle includes a galvanic conductive contact ring.

3. The coupling system of claim 1 wherein the at least one electrical contact in each of the coupler and receptacle includes an inductive coupling ring.

4. The coupling system of claim 1 further comprising a groove and anti-rotation lock pin combination formed into corresponding components of the receptacle and the coupling, such that rotation of the electrically operated device with respect to the tubing is prevented.

5. The coupling system of claim 1 wherein the pump has a diameter selected to enable movement thereof through the wellbore tubing.

6. The coupling system of claim 5 further comprising an annular seal disposed above an intake of the pump, and wherein an outlet of the pump is directed into the wellbore tubing such that the pump lifts fluids into the tubing toward the wellbore surface.

7. The coupling system of claim 1 further comprising at least one stabilizer disposed between an exterior of the pump system and an interior wall of the wellbore tubing.

8. The coupling system according to claim 1 comprising at least one port to allow hydraulic fluid to be routed through the coupler to operate tools directly and indirectly connected to the coupler.

9. The coupling system according to claim 8, where the at least one ports is used to transport chemicals and other selected materials for release into a well fluid stream at at least one location in the wellbore.

10. The coupling system according to claim 1 wherein a sealing arrangement between the coupler and the receptacle includes at least one port configured for flushing and to place dielectric fluid between the coupler and the receptacle when connecting the coupler and receptacle.

11. The coupling system according to claim 1 further comprising an electrical cable external to the wellbore tubing above the coupling system.

12. The coupling system according to claim 1 further comprising a device that prevents rotation of the coupler with respect to the receptacle when operating a tool coupled to the coupling system.

13. The coupling system according to claim 1 wherein the coupler and the receptacle do not require any rotational alignment for connecting and disconnecting thereof.

14. The coupling system according to claim 13 wherein the system is activated by setting down weight of the coupler into the receptacle.

15. The coupling system according to claim 13 further comprising an hydraulic line from the well surface coupled to the receptacle for flushing of the coupling system prior to and when landing the coupler into the receptacle.

16. The coupling system according to claim 13 further comprising an electronic system built into the coupling system for initiating flushing after a time delay or in response to signals from a sensor that detects mating of the coupler to the receptacle.

17. The coupling system according to claim 16 further comprising a coupler seal system to isolate electrical couplers from wellbore fluids, wherein the coupler seal system is activated by separate control line extending from the well surface.

18. The coupling system according to claim 1 where signals and/or data are transmitted through the coupling system.

19. The coupling system according to claim 1 wherein the coupler and the receptacle are configured to enable a shaft or rod to pass therethrough.

20. An electrical coupling system for use in a wellbore that enables insertion and removal of an electrically operated device in a wellbore, comprising:

an electrical receptacle mounted at a selected axial position along a tubing disposed in the wellbore, the receptacle including at least one insulated electrical conductor coupled to an electrical contact inside the receptacle and extending to the well surface; and an electrical coupler disposed on an exterior of the electrically operated device, the coupler including at least one electrical contact disposed proximate the receptacle contact when the coupler is mated to the receptacle, the coupler including at least one flow passage enabling wellbore fluid from below the coupler to an annular space between the electrically operated device and an interior of the tubing;

where the receptacle contains a sealing system coupled to a lower end of the receptacle, and wherein the sealing system provides a pressure tight seal with respect to the wellbore tubing when the coupler is installed in the receptacle.

21. An electrical coupling system for use in a wellbore that enables insertion and removal of an electrically operated device in a wellbore, comprising:

an electrical receptacle mounted at a selected axial position along a tubing disposed in the wellbore, the receptacle including at least one insulated electrical conductor coupled to an electrical contact inside the receptacle and extending to the well surface;

an electrical coupler disposed on an exterior of the electrically operated device, the coupler including at least one electrical contact disposed proximate the receptacle contact when the coupler is mated to the receptacle, the coupler including at least one internal flow passage enabling wellbore fluid flow from below the coupler, through the coupler, to an annular space above the coupler and between the electrically operated device and an interior of the tubing when the coupler is disposed on the exterior of the electrically operated device, wherein the coupler and the receptacle do not require any rotational alignment for connecting and disconnecting thereof;

a hydraulic line from the well surface coupled to the receptacle for flushing of the coupling system prior to and when landing the coupler into the receptacle; and a coupler seal system to hydraulically isolate electrical couplers from wellbore fluids, wherein the coupler seal system is activated by fluid pressure in the hydraulic line.

* * * * *